United States Patent [19]

Coull

[11] Patent Number: 4,905,849

[45] Date of Patent: Mar. 6, 1990

[54] OVERHOIST PREVENTION SYSTEM

[75] Inventor: George Coull, Ellon, United Kingdom

[73] Assignee: The British Petroleum Company p.L.c., London, England

[21] Appl. No.: 332,440

[22] Filed: Apr. 4, 1989

Related U.S. Application Data

[63] Continuation of Ser. No. 660,326, Oct. 12, 1984, abandoned.

[30] Foreign Application Priority Data

Oct. 15, 1983 [GB] United Kingdom ..... 8327682

[51] Int. Cl.[4] ..... B66C 13/18

[52] U.S. Cl. ..... 212/152; 212/153; 254/269; 307/99; 328/5

[58] Field of Search ..... 212/152, 153; 254/269; 377/17; 307/99, 116; 328/5; 294/66.2

[56] References Cited

U.S. PATENT DOCUMENTS

| | | | |
|---|---|---|---|
| 2,016,332 | 10/1935 | Lee | 254/269 |
| 2,637,525 | 5/1953 | Lock | 254/269 |
| 2,913,129 | 11/1959 | Lindstrom | 212/153 |
| 3,005,622 | 10/1961 | Garnier | 254/269 |
| 3,052,878 | 9/1962 | Berry | 254/269 |
| 3,317,714 | 5/1967 | Hausler et al. | 377/17 |
| 3,536,937 | 10/1970 | Uemura et al. | 328/5 |
| 3,565,402 | 2/1971 | Linke | 254/269 |
| 3,809,921 | 5/1974 | Formby | 307/116 |
| 3,872,458 | 3/1975 | Schedrovitsky et al. | 377/17 |
| 3,924,752 | 12/1975 | Hoofnagle | 212/153 |
| 3,940,577 | 2/1976 | Christofer | 254/269 |
| 4,138,709 | 2/1979 | Colwill | 328/5 |

*Primary Examiner*—Sherman D. Basinger
*Assistant Examiner*—Thomas J. Brahan
*Attorney, Agent, or Firm*—Morgan & Finnegan

[57] ABSTRACT

An overhoist prevention system suitable for use on a crane comprises (a) a proximity switch (17), (b) a movable detector plate (10) normally biassed away from the proximity switch, (c) an actuator (5) adapted for use with the hoist wire (4) for moving the detector plate towards the proximity switch and (d) a relay (21). The relay is actuated by a signal from the proximity switch and controls the operation of an alarm and/or the supply of the power to the winding drum of the crane.

1 Claim, 4 Drawing Sheets

OVERHOIST PREVENTION SYSTEM

Figure 1:
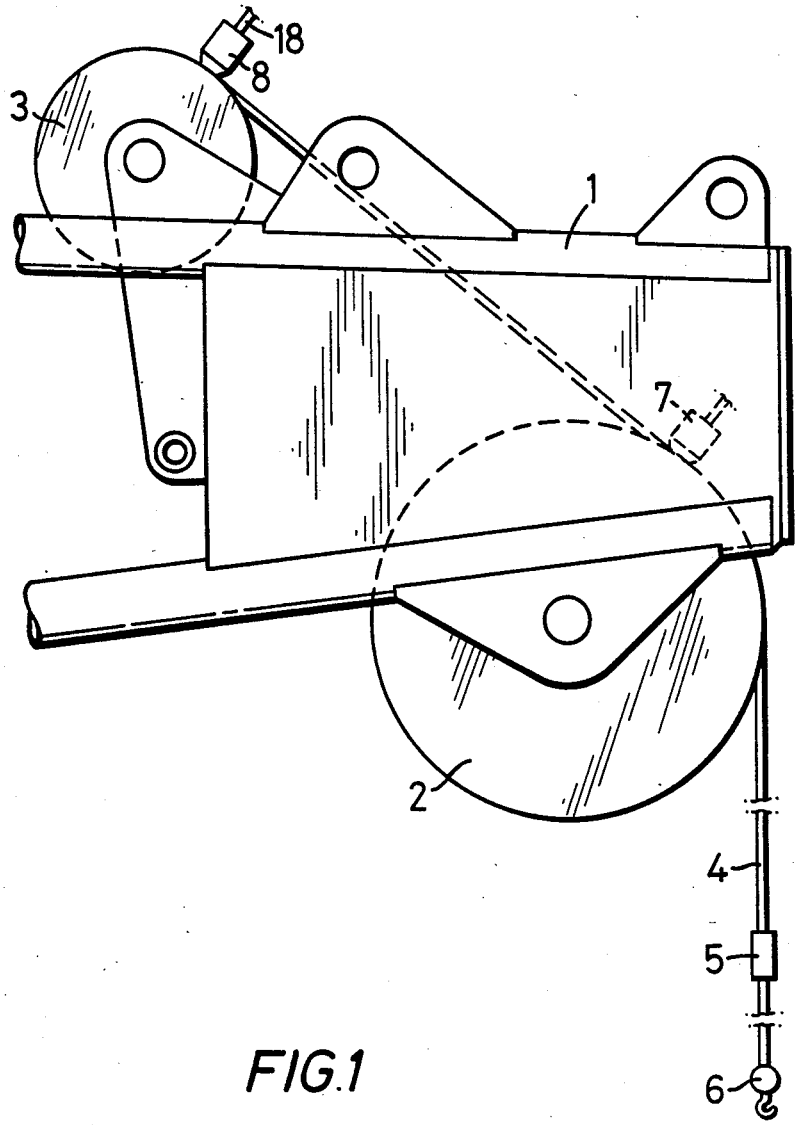

This is a continuation of co-pending application Ser. No. 660326, filed on Oct. 12, 1984, now abandoned.

This invention relates to an overhoist prevention system suitable for use on cranes, particularly jib cranes.

When operating a jib crane, it is always desirable and may sometimes be necessary, because of certification requirements, to provide a safety cut-out system to ensure that loads are not overhoisted to the boom tip, thus drawing the boom backwards, overstressing the crane and causing considerable damage.

One type of system which has been used is a revolution counter attached to the hoist wire winding drum. This, in effect, actuates the cut-out when a predetermined length of wire has been wound onto the drum. This system is to directly responsive to the position of the load and frequently gives rise to spurious cut-outs. Furthermore, it becomes more inaccurate with use as the hoist wire stretches.

One system which is responsive to the position of the load comprises a rectangular roller guide cage containing a number of rollers, eg four, through which the main hoist wire passes. The cage is suspended from the jib point by four wires attached to its corners, the wires being maintained under tension by the weight of the cage. One of the wires is connected to a spring loaded mechanical linkage which normally maintains the cut-out switch in the off position. A small plate is connected to the hoist wire a short distance above the jib hook and is positioned to engage the cage before overhoist occurs. When the plate engages the cage, the latter is raised, the tension on the cage wire is released and the mechanical linkage trips the cut out switch.

This system suffers from several disadvantages. Under certain conditions, the phenomenon known as "boom bounce" may develop in which the boom oscillates. This causes the suspending wires to slacken momentarily and actuate the cut-out. Another problem results from the tendency of the suspended cage to spin in use and become entangled in the hoist wire. This frequently means that the tension on the connecting cage wire is released and the cut-out is actuated in error. More importantly, the wires suspending the cage may eventually shear and allow the cage to fall, with obvious dangers to personnel and equipment below.

We have now devised an improved cut-out and/or alarm system which does not suffer from the above disadvantages.

Thus according to the present invention there is provided an overhoist prevention system suitable for use on a crane which system comprises (a) a proximity switch, (b) a moveable detector plate normally biassed away from the proximity switch, (c) an actuator adapted for use with the hoist wire for moving the detector plate towards the proximity switch and (d) a relay, the relay being actuated by a signal from the proximity switch and controlling the operation of an alarm and/or the supply of power to the winding drum of the crane.

The moveable detector plate is preferably biassed by spring loading.

Suitable proximity switches are available from Pepperl and Fuchs, O.H.G., Mannheim, Germany.

The actuator is preferably a sleeve which increases the diameter of the hoist wire. Most preferably it is fabricated from a flexible plastics or rubbery material which can be wrapped round the wire.

Preferably a cut-out system is preceded by a similar warning system in which the cut-out switch is replaced by an audible and/or visual alarm.

The system has the added advantage that dropping the crane hook onto the ground also actuates it, presumably because the impact is transmitted to the wire which momentarily jumps off its sheave, thus lifting the detector plate and triggering the proximity switch.

The system is preferably constructed from corrosion and heat resistant materials with all electrical connections enclosed within flameproof junction boxes. It is then very suitable for use in harsh and hazardous environments such as those encountered on offshore oil production and/or drilling platforms.

Figure 2:
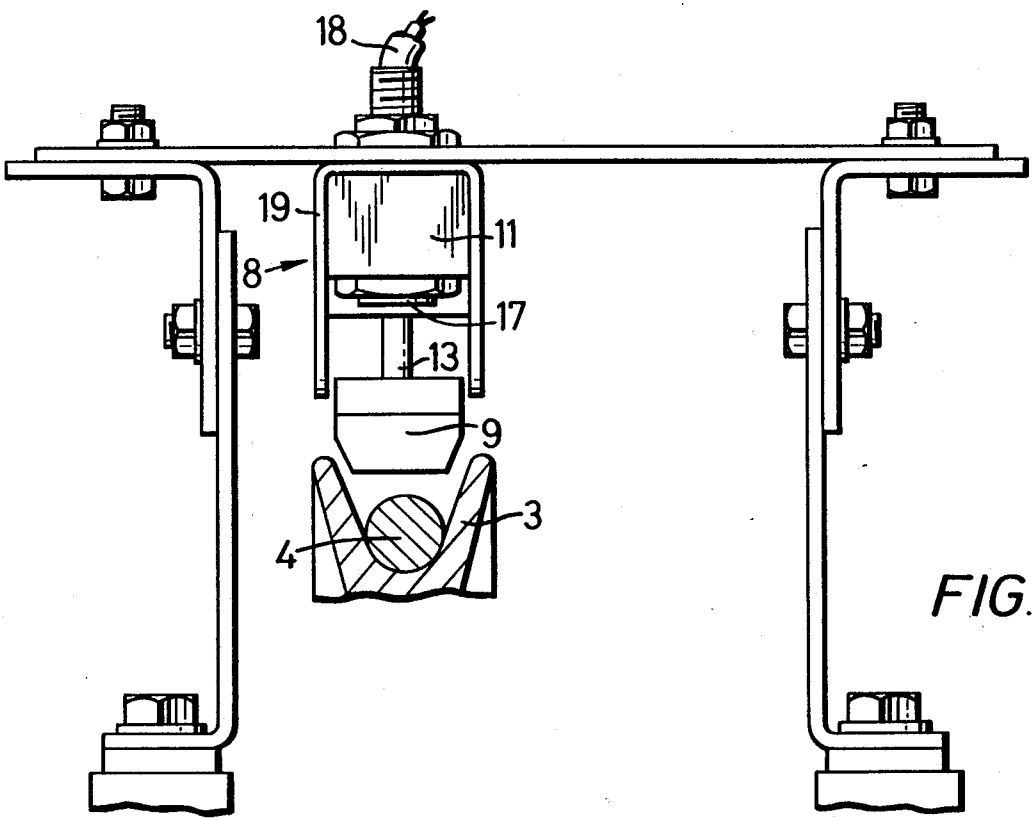
Figure 3:
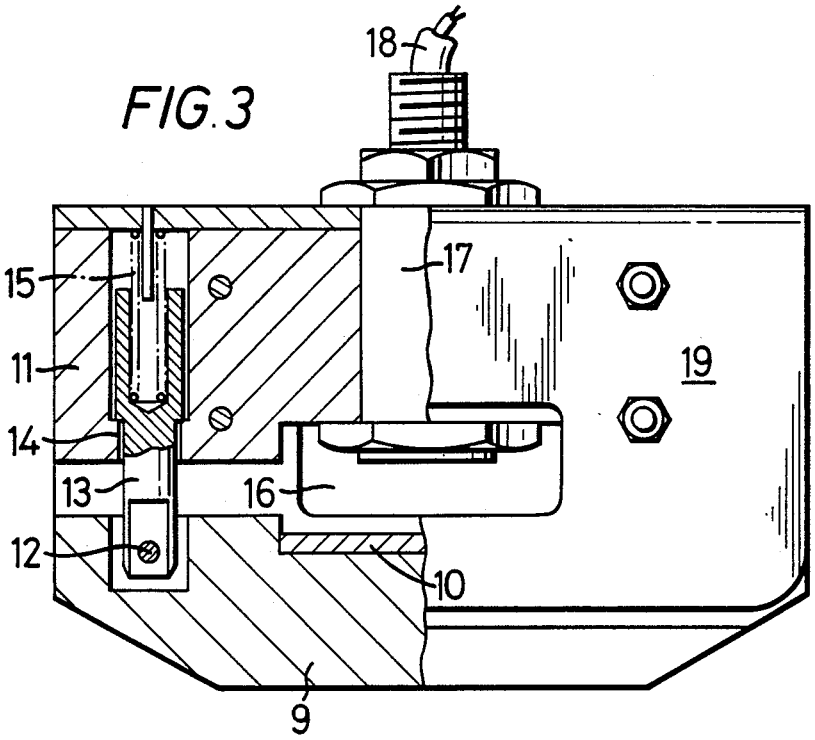
Figure 4:
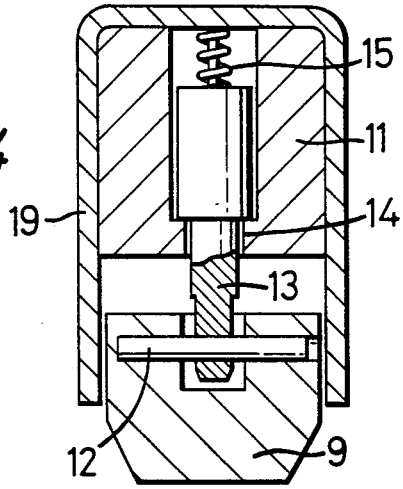
Figure 5:
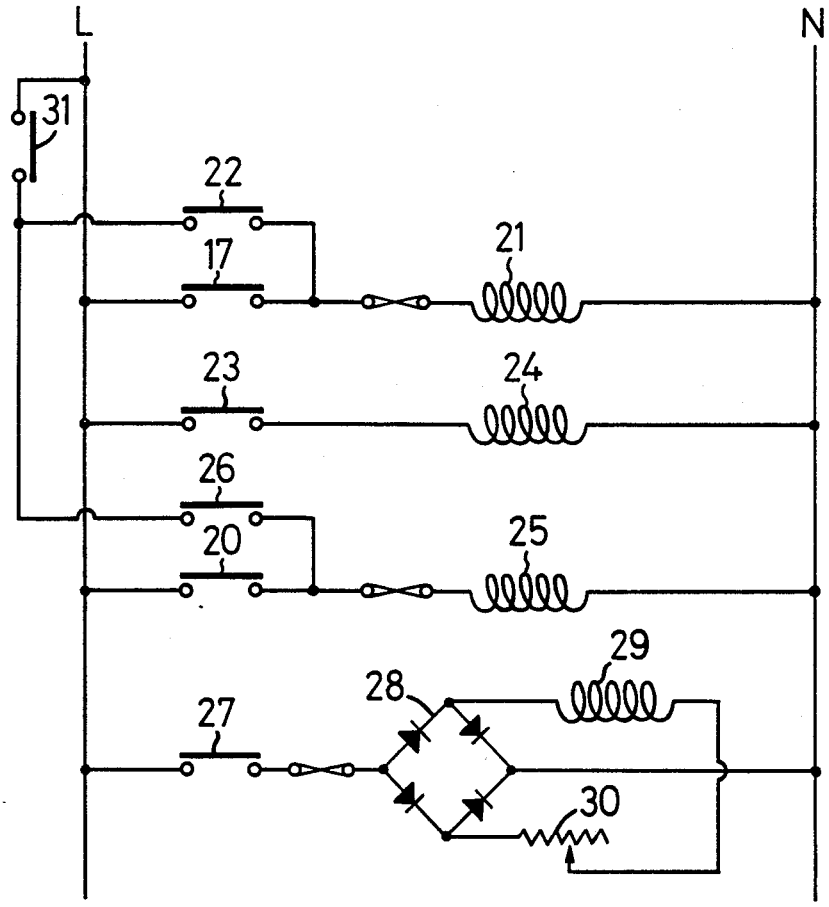

The invention is illustrated with reference to FIGS. 1–5 of the accompanying drawings wherein FIG. 1 is a side elevation of a boom end, FIG. 2 is an end elevation, FIGS. 3 and 4 are elevations, partially in section of a proximity switch/detector plate assembly and FIG. 5 is a circuit diagram.

With reference to FIGS. 1–4, a crane boom end 1 is fitted with two sheaves 2 and 3 over which the main hoist wire 4 passes. The wire is fitted with a polyethylene actuation sleeve 5 near its end and a hook 6 at its end.

A proximity switch/detector plate alarm assembly 7 is fitted adjacent to sheave 2 and a proximity switch/detector plate cut-out assembly 8 adjacent to sheave 3.

Assemblies 7 and 8 each compise a shoe 9 fabricated from polypropylene bearing a stainless steel detector plate 10. The shoe 9 is coupled to the body 11 of the assembly by means of horizontal and vertical pins 12 and 13 respectively. Pin 13 is positioned in channel 14 and spring loaded by spring 15 so that the shoe 9 and plate 10 are normally urged away from the body 11. The body 11 contains a central aperture 16 into which is fitted a proximity switch 17 and its connecting lead 18. The assembly is surrounded by a cover plate 19.

With additional reference to FIG. 5.

When actuation sleeve 5 reaches the detector assembly 7 its thickened section causes a shoe 9 to rise and with it a detector plate 10. This brings it close to the proximity switch 17 in assembly 7. When the proximity switch is triggered it energises relay 21 which closes switches 22 and 23 and operates solenoid valve 24 to actuate an air horn.

If the warning is ignored and hoisting continues, actuation sleeve will reach the detector assembly 8 where again its thickened section causes a shoe 9 to rise and with it a detector plate 10. This brings it close to the proximity switch 20 in assembly 8. When the proximity switch is triggered it energises relay 25 which closes switch 26 and cuts off the supply of electricity to the winding drum.

The supply to relay 21, solenoid valve 24 and relay 25 is 110 volts A.C.

Energising relay 25 also closes switch 27 which brings rectifier 28 into the circuit. This converts the supply to 24 volts. D.C. and actuates a solenoid valve 29 which releases air from the crane's pneumatic brake system, thus applying and locking the brake in the "on" position.

The voltage of the out-put from the rectifier 28 is controlled by a dropper resistor 30.

In order to disengage the system, reset switch 31 is operated. This breaks the circuit, de-energises relays 21 and 24 and opens switches 22, 23, 26 and 27, thus restoring electric power to the winding drum, pneumatic actuation to the brake and silencing the alarm.

I claim:

1. An overhoist prevention system capable of dealing with various dynamic loads suitable for use on a crane comprising a hoist wire, a winding drum and a supply of power, the system comprising (a) a first proximity switch adapted to actuate an alarm, (b) a second proximity switch adapted to actuate a cut-off, (c) a first movable detector plate normally biased away from the first proximity switch (d) a second movable detector plate normally biased away from the second proximity switch, (c) a flexible actuator capable of running over a sheave and adapted for use with the hoist wire for moving the detector plates towards the proximity switches, (f) a first relay being actuated by a signal from the first proximity switch and controlling the operation of an alarm, (g) a brake mechanism and (h) a second relay being actuated by a signal from said second proximity switch and controlling the power to the winding drum and the brake mechanism, the arrangement of the proximity switches being such that the switches are actuated sequently by the detector plates, the first proximity switch being actuated firstly to actuate the alarm and the second proximity switch being actuated subsequently to cut-off the supply of power to the winding drum and to actuate the brake mechanism to lock the brake in the on position.

* * * * *